United States Patent [19]

Josse

[11] 4,079,192

[45] Mar. 14, 1978

[54] CONDUCTOR FOR REDUCING LEAKAGE AT HIGH FREQUENCIES

[76] Inventor: Bernard Josse, Favenue Piene Grenici, 92100 Boulogne, France

[21] Appl. No.: 478,602

[22] Filed: Jun. 12, 1974

[30] Foreign Application Priority Data

Jun. 12, 1973 France ..... 73 21323

[51] Int. Cl.[2] ..... H01B 5/00; H01B 9/02

[52] U.S. Cl. ..... 174/126 CP; 174/36; 174/113 R; 174/130

[58] Field of Search ..... 174/36, 126 R, 126 CP, 174/128, 130, 131 A, 113 R, 114 R, 102 SC, 105 SC, 120 SR, 120 SC, DIG. 5, 15 C, 27, 34

[56] References Cited

U.S. PATENT DOCUMENTS

| | | | |
|---|---|---|---|
| 1,672,979 | 6/1928 | Fondiller | 174/126 CP |
| 2,048,450 | 7/1936 | Horn | 174/114 R X |
| 3,109,053 | 10/1963 | Ahearn | 174/126 CP X |
| 3,301,937 | 1/1967 | Burnier et al. | 174/DIG. 6 |
| 3,594,492 | 7/1971 | Bahder et al. | 174/113 R UX |
| 3,639,672 | 2/1972 | Kafka | 174/15 C |
| 3,643,004 | 2/1972 | McKean | 174/105 SC X |

FOREIGN PATENT DOCUMENTS

| | | | |
|---|---|---|---|
| 2,050,913 | 4/1972 | Germany | 174/36 |

*Primary Examiner*—Arthur T. Grimley
*Attorney, Agent, or Firm*—Brisebois & Kruger

[57] ABSTRACT

Conductive wire coated with a thin magnetic film which is encircled by an insulating sheath. In various applications a plurality of said wires are wound together to provide a conductor having a low leakage due to eddy currents and dielectric leakage at certain frequencies.

16 Claims, 7 Drawing Figures

CONDUCTOR FOR REDUCING LEAKAGE AT HIGH FREQUENCIES

There are known problems of skin effect, which occur in particular at high frequency and which have led to dividing-up of leads, in particular to reduce their eddy current leakage, and to the production of so-called LITZ multi-strand leads in which the useful current passage section represents a distinctly larger fraction of the total passage section of the assembly of strands forming the said leads than that which can be obtained using unifilar leads of the same external diameter.

However, in fact the use of LITZ leads can only partially remedy the skin effect mentioned above, which becomes greater as a higher frequency is used, for if finer and finer wires are used at very high frequencies, the dielectric leakage in the insulating sheaths becomes preponderant.

The invention which is the object of the present Application is based on the use, between the conductive cores of the different strands forming a lead and the insulating sheaths of each of these strands, of films of magnetic material respectively forming zones of concentration of the lines of magnetic force induced by an external magnetic field which may be produced by the currents passing in other portions of the said strands.

Because of the thinness of the said magnetic films and the higher electric resistivity of the material of which they are formed, relative to that of the metal forming the conductive cores of the above-mentioned strands, the eddy currents circulating within these films, together with the corresponding leakage, are considerably reduced.

The process is applicable in particular to conductors in the superconductive or hyperconductive states.

Furthermore the said magnetic films may be formed chemically or electrochemically as the case may be, or possibly by an electrostatic process, by electrophoresis, by vacuum deposition or by any equivalent process. These magnetic films may also be formed by agglomeration of metallic powder of magnetic nature or of similar mixed oxides by means of a suitable insulating binder.

They may also be obtained by drawing or stretching a metal bar of large diameter, previously covered with a layer of magnetic material.

These magnetic films may also be produced by winding one or two superimposed layers of strips of a magnetic metal or alloy, helically in substantially contiguous turns, between the conductive cores and the insulating sheaths of the different strands.

As a modification, it is possible to cover each conductive core of small diameter with at least two superimposed layers of magnetic material separated from each other by an electrically insulating layer.

Independently of the task of concentrating the lines of magnetic force, which has been mentioned above, a further advantage of the use of the said magnetic films resides in the fact that these films simultaneously reduce the magnetic field between adjacent strands and, consequently, the voltage induced between these strands, which considerably reduces the dielectric leakage in the insulating sheaths of the said strands, relative to the use of LITZ leads of known types.

This reduction of dielectric leakage permits use of the novel multi-strand leads at substantially higher frequencies than if LITZ leads of known types were being used.

As to the insulating layer of the sheaths of the different strands mentioned above, it no longer serves only, as in the LITZ leads, to insulate the different strands electrically from each other to eliminate leakage by circulation currents between these strands: it also serves to magnetically insulate the different strands from each other, sufficiently reducing the resultant magnetic field created by the currents passing in all of these strands.

The thickness of the layer of magnetic material generally varies between $\frac{1}{3}$ and 1/100 of the radius of each strand of a divided lead in accordance dance with the invention.

The thickness of each of the above-mentioned insulating sheaths generally varies between 1/10, and $\frac{1}{3}$ of the radius of the metallic conductive core of the corresponding strand.

The reduction in leakage by eddy current, which is obtained in accordance with the invention, permits, all things considered, an increase in the useful fraction of the current passage section of a solid lead like a LITZ lead.

In the case of connections formed by two coaxially arranged composite conductors, the self-inductance of such connections is increased, which represents no small advantage for medium or shot distance wire telecommunications, but can on the other hand be a problem in the case of very long distance telecommunications, for such an increase causes a reduction in the propagation velocity of the current.

For the superconductive cables formed in accordance with the invention, the value of the external critical field can be considerably increased and magnetic instability can be reduced.

In the case of connections at industrial frequency for very high intensities, for example greater than 5000 amperes, it may be advantageous to replace the tubular leads of known type with leads formed in accordance with the invention.

It will be observed below that the best results, both from the point of view of leakage by eddy currents and from the point of view of dielectric leakage in the insulating sheaths of the different strands of the novel divided leads, are obtained using a ply arrangement of similar type to that normally used for the strands of LITZ leads.

However, it will be observed below that the elementary plies, which in the case of LITZ leads only include a single layer of unifilar strands twisted around an insulating core, can in accordance with the invention include a considerable number of simultaneously twisted layers.

Each of the above-mentioned elementary plies may optionally be covered with an insulating sheath.

It is possible, even for these elementary plies, not to use the central portion of the ply, by providing a solid or tubular central insulating core.

A certain number of elementary plies may be wound helically around a central insulating core, which may also be solid or tubular, to form either a secondary ply or the composite cable itself.

A certain number of secondary plies may be wound in the same manner around a solid or tubular insulating central core, to form a tertiary ply or the composite cable itself, and so on.

The number of strands or plies used to form the plies of higher degree can vary depending on the useful section required.

In the case of coaxial cables, the central conductor includes a certain number of elementary, secondary or nth degree plies wound helically around an insulating core or insulating support of this central conductor.

As to the outer conductors of the said coaxial cables, they are formed similarly by helically winding a certain number of elementary, secondary or nth degree plies around a tubular support surrounding the said inner conductor and coaxial with the latter.

It should also be noted that each elementary ply or ply of any degree may have an insulating sheath, separated from the said ply by a magnetic layer.

The limiting number of strands and the degree of the ply arrangement depend on a certain number of parameters, in particular on the radius of the wire used for each of the unifilar strands, on the permeability and thicknesses of the layer of magnetic material and the insulation, on the current frequency, on the dielectric constant of this insulation and on its leakage factor.

It is self-evident that for very high frequency electric connection applications, the magnetic material will preferably be magnetic metal or mixed oxide powders agglomerated by means of an insulating binder enabling these powders to be made to adhere to the said conductive cores, this application leading to minimal leakage by eddy currents.

Such composite leads may also be used to form low frequency connections, in particular in the case of superconductive or hyperconductive material, where leakage by eddy currents or circulation currents between the wires of a multi-strand lead of the conventional type becomes considerable.

Such composite leads may also be used to form the windings of high frequency self-induction coils having reduced leakage by eddy currents and/or minimal dielectric leakage.

In this case, independently of the elementary or variable degree plies, in certain cases a solid unifilar conductor may be used having, in accordance with the invention, a thin sheath of magnetic material separating its conductive core from its insulating sheath.

The novel composite leads may also be used to form the induction coils of induction-heated furnaces or to form the windings of high power electric machines.

It will be noted that the increase in useful section which may be obtained with LITZ leads is limited by the fact that the minimum diameter of the strands is limited by economic considerations, just as by technical considerations such as the mechanical strength of these strands, and in addition a further limit is formed by the increase in dielectric leakage in the insulating sheaths of the different strands.

In the case of the composite leads in accordance with the present invention, a considerable reduction in diameter may be obtained for a same useful section, while using currently manufactured strands whose ply arrangement is simplified as a result of the possiblity of increasing the number of strands in the elementary plies.

Furthermore, for frequencies higher than 2 MHz at which LITZ leads cannot be used because of their excessive dielectric leakage, the comparison with solid leads is also to the advantage of the novel composite leads both as regards the diameter of the cable and as regards the possibility of using currently manufactured strands.

For very high frequency applications, such as equipment for heating by dielectric leakage, power aerial cables and teletransmission cables, table 1 below provides, by way of example, as a function of a certain number of parameters such as the diameter of the copper wire used, the thickness of the magnetic layer and that of the insulation, the number of unifilar strands to be used at different very high frequencies, the diameter of the composite lead formed, the useful section of the said composite lead and the useful section of a solid lead of the same external diameter.

This table shows that the gain in useful section for a same diameter is multiplied, depending on the frequency, by a number between 4 and 7.

TABLE 1

Composite cables used at very high frequency: > 1 MHz
cables for equipment for heating by dielectric leakage
cables of power aerials
teletransmission cables

| | | | |
|---|---|---|---|
| Working frequency in MHz | 4 | 20 | 100 |
| diameter of the copper wire in mm | 0.02 | 0.01 | 0.02 |
| thickness of the magnetic layer in microns | 1 | 1 | 3 |
| nature of the layer | iron | iron | mixed oxides |
| thickness of the insulation in microns | 2 to 3 | 2 to 3 | 2 to 3 |
| number of wires forming the cable | 25 000 | 30 000 | 1 000 |
| diameter of the composite conductor in mm | 10 | 10 | 3 |
| useful section of the composite cable in $mm^2$ | 7.5 | 2.2 | 0.3 |
| useful section of a solid lead of same external diameter in $mm^2$ | 1.1 | 0.5 | 0.07 |

In the case of use at medium and high frequency, i.e., at frequencies of between 1 kilohertz and 1 megahertz, as for cables intended for induction heating equipment, where the largest leakages are the eddy current leakages, teletransmission cables operating at frequencies higher than 100 kilohertz and the windings of medium frequency induction heating coils, for example, table 2 below gives, as a function of the diameter of the copper wire used, of the thickness of the magnetic layer and of that of the insulating sheaths, the number of unifilar strands to be placed in parallel in each case, the diameter of the composite lead thus formed, its useful section and the maximum admissible intensity in a coaxial cable comprising two concentric conductors.

TABLE 2

Composite cables used at medium and high frequency (1 to 1 000 kHz)
cables for induction heating equipment (leakage by eddy currents)
teletransmission cables (f > 100 kHz)
induction coil for heating at medium frequency.

| | 20 kHz | | 200 kHz | |
|---|---|---|---|---|
| diameter of the copper wire in mm | 0.6 | 0.6 | 0.12 | 0.20 |
| thickness of the magnetic layer (iron) in microns | 4 | 4 | 3 | 5 |
| thickness of the insulation of the wire in mm | 0.06 | 0.06 | 0.01 | 0.02 |
| number of wires | 1 300 | 220 | 12 000 | 1 300 |
| diameter of the composite lead in mm | 45 | 15 | 40 | 15 |
| useful section in $mm^2$ | 360 | 60 | 140 | 40 |
| admissible current in a cable comprising two concentric conductors in amperes | 600 to 700 | 180 to 220 | 400 to 450 | 150 to 180 |

By comparison, table 3 gives the same data for LITZ leads of the same diameter, i.e. their useful section, the number of unifilar strands and the diameter of the copper wire to be used.

For the same lead diameters appearing in this table, these data are as follows:

TABLE 3

| | | | | |
|---|---|---|---|---|
| diameter of the copper wire in mm | 0.16 | 0.16 | 0.04 | 0.06 |
| number of wires | 7 800 | 1 300 | 60 000 | 5 000 |
| diameter of the lead in mm | 45 | 15 | 40 | 15 |
| useful section in $mm^2$ | 155 | 26 | 72 | 14 |

Also below will be examined the case of the use of the composite cables in accordance with the invention at industrial frequency, for conveying high intensity currents greater than 5000 amperes with the use of hyperconductors cooled by circulation of liquid nitrogen.

The most advantageous metal to use in this case is beryllium whose resistivity is one hundred times less at the temperature of liquid nitrogen than that of copper at ordinary temperature.

Table 4 below will permit comparison, for different useful passage sections of currents of increasingly high intensity, of the respective diameters of the wires forming each unifilar strand, the respective numbers of wires to be used and the diameters of the composite leads in the case of LITZ leads end of the leads in accordance with the present invention.

TABLE 4

Industrial frequency (50 Hz) cable for conveying very high currents (> 5 000 A) with the use of hyperconductors cooled by circulation of liquid nitrogen (80° K).

(Beryllium of resistivity one hundred times less than that of copper at ordinary temperature.)

| | Composite lead | | LITZ lead |
|---|---|---|---|
| Useful section 1 100 $mm^2$ | diameter of wire | 1 mm | 0.4 mm |
| | diameter of lead | 9 cm | 11 cm |
| | number of wires | 1 300 | 8 000 |
| Useful section 1 600 $mm^2$ | diameter of wire | 1 mm | 0.5 mm |
| | diameter of lead | 12 cm | 14 cm |
| | number of wires | 2 000 | 8 000 |
| useful section 2 200 $mm^2$ | diameter of wire | 1 mm | 0.24 mm |
| | diameter of lead | 18 cm | 22 cm |
| | number of wires | 2 800 | 50 000 |

It will be observed that in all these cases the diameter of the wire to be used to form the strands of the LITZ leads is very much smaller than that of the strands forming the composite leads in accordance with the invention, that the diameter of these LITZ leads is a little larger than that of the leads in accordance with the present invention and that the number of unifilar strands to be used is on the other hand considerably greater in the case of the said LITZ leads, as a result of which a considerable cost saving may be effected by the use of the novel composite leads.

To provide a better understanding of the invention, a certain number of examples of composite leads in accordance with the invention will be described as non-limiting examples, with reference to the attached drawings in which.

Figure 4:
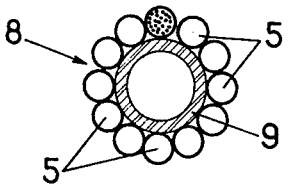
FIG. 4 is a cross section comparable to that of FIG. 3, but containing twelve elementary plies of the same type wound helically around a tubular insulating core.
Figure 7:
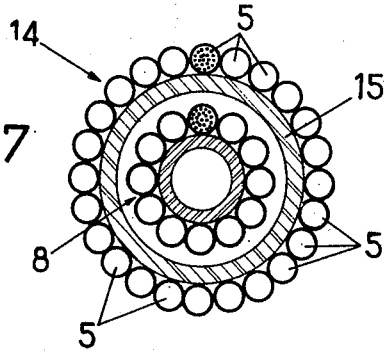

and FIG. 7 is a cross section of a coaxial cable comprising an inner composite conductor of the type shown in FIG. 4, surrounded by an outer conductor comprising comprising twenty-four elementary plies wound helically round a tubular insulating core of larger diameter.

Figure 1:
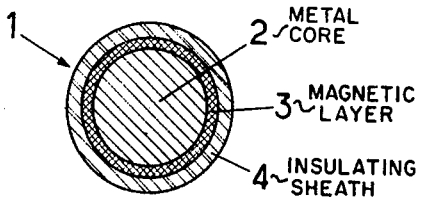
FIG. 1 is a cross section of a unifilar lead strand in accordance with the invention, covered with a magnetic layer separating its conductive core from its insulating protective sheath.

FIG. 1 shows that each strand 1 has a metal core 2 covered by any suitable means by a magnetic layer 3 itself surrounded by an insulating sheath 4.

Figure 2:
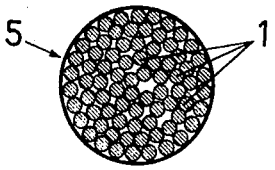
FIG. 2 is a cross section of an elementary ply formed by twisting a certain number of unifilar strands of the type shown in FIG. 1.

The elementary ply 5 of FIG. 2 is obtained by twisting a large number of unifilar strands each corresponding to the larger scale section of FIG. 1.

Figure 3:
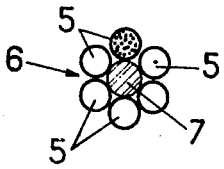
FIG. 3 is a cross section of a so-called secondary ply, obtained by helically winding six elementary plies of the type shown in FIG. 2 around a solid insulating core.

The composite cable shown in FIG. 3 comprises six elementary plies 5 of the type shown in FIG. 2, wound helically around a solid insulating core 7.

The composite cable 8 shown in FIG. 4 comprises twelve elementary plies 5 wound helically around a tubular insulating core 9.

Figure 5:
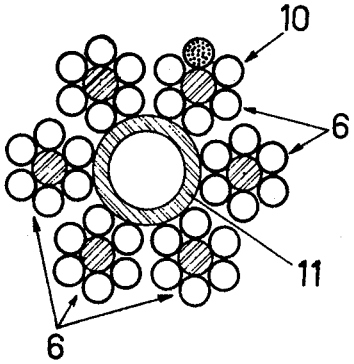
FIG. 5 is a cross section of a composite cable having six secondary plies of the type shown in FIG. 3 wound helically around a tubular insulating core.

The composite cable 10 shown in FIG. 5 comprises six secondary plies of the type shown in FIG. 3, wound helically around an insulating tubular core 11.

Figure 6:
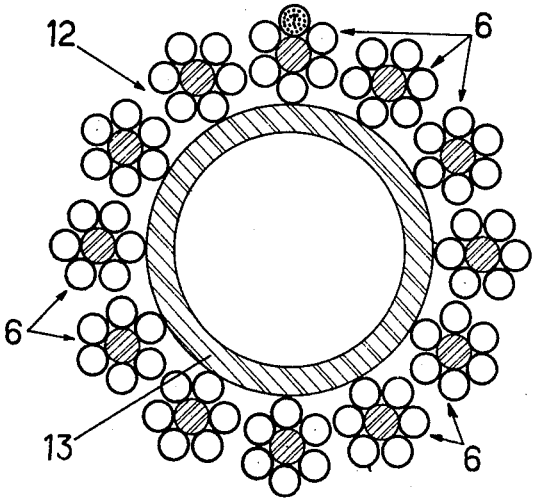
FIG. 6 is a cross section comparable to FIG. 5, but including the use of twelve secondary plies wound helically around a tubular insulating core of larger diameter.

The composite conductor 12 shown in FIG. 6 comprises twelve secondary plies of the type shown at 6 in FIG. 3, wound helically around a tubular insulating core 13 of larger diameter.

Lastly, the coaxial cable shown in FIG. 7 comprises an inner conductor 8 of the type shown in FIG. 4 and an outer conductor 14 formed of twenty-four plies 5 of the type shown in FIG. 2, wound helically around a tubular insulating core 15.

It will be appreciated that the embodiments described above are only given as non-limiting examples and that it is possible, as mentioned above, to replace certain solid insulating cores with hollow insulating cores of suitable thickness or vice versa, and to modify the distance between the inner conductor and the outer conductor of a coaxial cable, without thereby detracting from the general economy of the invention.

It is also possible to adapt the diameters of the tubular insulating cores according to the number of elementary, secondary or nth degree plies which must be wound helically around these cores.

What I claim is:

1. Method of reducing the Joule losses in each conductive wire of a multistrand electrical conductor carrying frequencies in excess of 50 KHz, which losses result from the eddy currents induced by the magnetic fields generated by the currents which pass through the other conductive wires of said multi-strand conductor, which method comprises the steps of covering each conductive wire in said multi-strand conductor with an individual sheath of magnetic material which absorbs and concentrates the flux of said magnetic fields, and surrounding each sheath of magnetic material with an electrically and magnetically insulating sheath.

2. Method as claimed in claim 1 in which said sheath of magnetic material is a thin continuous film of said magnetic material.

3. Method as claimed in claim 1 which comprises the step of coating said insulating sheath with a second sheath of magnetic material and superimposing thereon a second insulating sheath.

4. Method as claimed in claim 1 which comprises the additional step of winding a plurality of said multistrand conductors about a central core.

5. A multistrand conductor for carrying alternating current at a frequency in excess of 50 KHz which comprises a plurality of conductive wires, each covered by a sheath of magnetic material for absorbing the magnetic flux of the magnetic fields generated by the currents passing through the other conductive wires of said multistrand conductor, and each sheath of magnetic material being surrounded by a sheath of electrically and magnetically insulating material.

6. Conductor as claimed in claim 5 in which said sheath of magnetic material is a thin continuous film of said magnetic material.

7. Conductor as claimed in claim 5 in which said magnetic sheath is made of a material selected from the group consisting of magnetic metals and ferromagnetic alloys.

8. Conductor as claimed in claim 7 in which said magnetic sheath is made of an iron alloy.

9. Conductor as claimed in claim 7 in which said magnetic sheath comprises a powder selected from the group consisting of magnetic metals and mixed magnetic oxides agglomerated by an insulating binder.

10. Conductor comprising a plurality of multistrand conductors as claimed in claim 5, wound about a central core.

11. Conductor as claimed in claim 10 in which said core is made of an insulating material.

12. Conductor as claimed in claim 11 in which said core is hollow.

13. Conductor as claimed in claim 12 in which said hollow core contains a composite conductor comprising a plurality of individual wires, each provided with a magnetic coating covered by an insulating coating and wound together to form a composite conductor.

14. Conductor as claimed in claim 5 in which said wire is made of beryllium and cooled by circulation of liquid nitrogen.

15. Conductor as claimed in claim 5 in which the individual wires have a diameter of 0.02 – 1.0 mm.

16. Conductor as claimed in claim 15 in which the thickness of the sheaths of magnetic material lies between $\frac{1}{3}$ and 1/100 of the radius of the individual wires.

* * * * *